US010549827B2

(12) United States Patent
Lee

(10) Patent No.: US 10,549,827 B2
(45) Date of Patent: Feb. 4, 2020

(54) LIFE VEST

(71) Applicant: Young Seok Lee, Hwaseong-si (KR)

(72) Inventor: Young Seok Lee, Hwaseong-si (KR)

( * ) Notice: Subject to any disclaimer, the term of this patent is extended or adjusted under 35 U.S.C. 154(b) by 0 days.

(21) Appl. No.: 15/578,922

(22) PCT Filed: Apr. 24, 2017

(86) PCT No.: PCT/KR2017/004334

§ 371 (c)(1),
(2) Date: Dec. 1, 2017

(87) PCT Pub. No.: WO2017/222162

PCT Pub. Date: Dec. 28, 2017

(65) Prior Publication Data

US 2019/0100290 A1 Apr. 4, 2019

(30) Foreign Application Priority Data

Jun. 21, 2016 (KR) ..... 10-2016-0077515

(51) Int. Cl.
*B63C 9/115* (2006.01)
*A44B 11/25* (2006.01)
*B63C 9/11* (2006.01)

(52) U.S. Cl.
CPC ..... *B63C 9/115* (2013.01); *A44B 11/25* (2013.01); *B63C 9/11* (2013.01)

(58) Field of Classification Search
CPC ..... B63C 9/115; B63C 9/11; A44B 11/25
See application file for complete search history.

(56) References Cited

U.S. PATENT DOCUMENTS 4,668,202 A * 5/1987 Scheurer ..... B63C 9/115 441/112
4,936,805 A * 6/1990 Piatt, Jr. ..... A41D 13/0531 441/106
4,993,980 A * 2/1991 Dulin ..... A61H 37/005 441/106

(Continued)

FOREIGN PATENT DOCUMENTS

CN 201971137 U 9/2011
CN 102448337 A 5/2012

(Continued)

OTHER PUBLICATIONS

International Search Report PCT/ISA/210 for International Application No. PCT/KR2017/004334 dated Jul. 25, 2017.

(Continued)

*Primary Examiner* — S. Joseph Morano
*Assistant Examiner* — Jovon E Hayes
(74) *Attorney, Agent, or Firm* — Dinsmore & Shohl LLP; Wisu Sul; Miyoung Shin

(57) ABSTRACT

A life vest includes a main body, a pair of front coupling member, and a pair of rear coupling member. The main body is divided into a front part surrounding an abdomen and a chest portion, and a rear part surrounding a back portion and having an storage space defined therein. The pair of front coupling members extend from the front part. The pair of rear coupling members are disposed adjacent to the pair of storage spaces and respectively include buckles of different kinds.

14 Claims, 19 Drawing Sheets

(56) References Cited

U.S. PATENT DOCUMENTS

| | | | | |
|---|---|---|---|---|
| 5,346,419 | A * | 9/1994 | Kaiser | B63C 11/08 114/315 |
| 6,120,213 | A * | 9/2000 | Stinton | B63C 11/08 405/186 |
| 6,216,272 | B1 * | 4/2001 | Rosengren | A41D 13/0012 2/102 |
| 6,582,267 | B1 * | 6/2003 | Steger | B63C 9/115 441/112 |
| D548,401 | S | 8/2007 | Tinao | |
| RE42,238 | E * | 3/2011 | Courtney | B63C 9/1055 116/26 |
| 8,002,159 | B2 * | 8/2011 | Cragg | A45F 5/02 224/579 |
| 9,045,206 | B2 * | 6/2015 | Flythe, Jr. | B63C 9/1255 |
| 9,802,685 | B2 * | 10/2017 | Kent | B63C 9/1255 |
| 2004/0211690 | A1 * | 10/2004 | Ho | A45F 3/14 206/373 |
| 2006/0099864 | A1 * | 5/2006 | Crumrine | B63C 9/08 441/106 |
| 2007/0004298 | A1 * | 1/2007 | Ganley | B63C 9/1255 441/88 |
| 2008/0153370 | A1 * | 6/2008 | Wagner | B63C 9/11 441/115 |
| 2009/0233504 | A1 | 9/2009 | Nelson et al. | |
| 2012/0033411 | A1 | 2/2012 | Heo | |
| 2013/0005203 | A1 * | 1/2013 | Barbis | B63C 9/11 441/106 |
| 2014/0261406 | A1 * | 9/2014 | Fabian | B63C 9/18 128/202.14 |
| 2016/0101822 | A1 * | 4/2016 | Schvey | A41F 15/00 2/310 |
| 2019/0100290 | A1 * | 4/2019 | Lee | A44B 11/25 |

FOREIGN PATENT DOCUMENTS

| | | | |
|---|---|---|---|
| CN | 103552535 | A | 2/2014 |
| CN | 203581356 | U | 5/2014 |
| CN | 103921912 | A | 7/2014 |
| JP | 3075834 | U | 3/2001 |
| JP | 4272950 | B2 | 6/2009 |
| KR | 2003/0087848 | A | 11/2003 |
| KR | 20-0424593 | Y1 | 8/2006 |
| KR | 2010/0018633 | A | 2/2010 |
| KR | 2010/0136166 | A | 12/2010 |
| KR | 2015/0002042 | U | 5/2015 |
| KR | 2015/0004405 | U | 12/2015 |

OTHER PUBLICATIONS

Written Opinion of the International Searching Authority PCT/ISA/237 for International Application No. PCT/KR2017/004334 dated Jul. 25, 2017.

* cited by examiner

LIFE VEST

CROSS-REFERENCE TO RELATED APPLICATIONS

This application is a national phase under 35 U.S.C. § 371 of PCT International Application No. PCT/KR2017/004334 which has an International filing date of Apr. 24, 2017, which claims priority to Korean Application No. 10-2016-0077515, filed Jun. 21, 2016, the entire contents of each of which are hereby incorporated by reference.

TECHNICAL FIELD

The present invention disclosed herein relates to life vest that helps a person to float on a water surface.

BACKGROUND ART

In general, as life-saving means to cope with safety accidents that occur in swimming, a life vest is a safety item to be worn by people in swimming or by rescue workers for safety.

Further, the life vests are indispensably equipped in vessels cruising on rivers or seas.

Such life vests have a basic function of lifting a human body above the water surface in water activities, and an additional function of protecting the human body from hypothermia and an external impact as well.

DISCLOSURE OF THE INVENTION

Technical Problem

The present invention provides a life vest capable of connecting adjacent persons at once, thereby enhancing efficiency of life saving.

The present invention also provides a life vest that helps people in water to be easily rescued by a helicopter.

Technical Solution

Embodiments of the present invention provide life vests including a main body, a pair of front coupling members, and a pair of first rear coupling members. The main body may be divided into a front part for surrounding an abdomen or a chest portion, and a rear part for surrounding a back portion and having a pair of first storage spaces defined therein. The pair of front coupling members may extend from the front part. The pair of first rear coupling members may be disposed adjacent to the pair of first storage spaces and include buckles of different kinds, respectively.

In an embodiment, the main body may include a buoyant member floating on water by buoyancy in water, a frame disposed adjacent to the buoyant member, and an outer cover wrapping the buoyant member and the frame therein.

In an embodiment, the frame may include a right frame to be worn on a right shoulder, a left frame to be worn on a left shoulder, and a middle frame connecting the right frame and the left frame.

In an embodiment, the pair of first rear coupling members may be divided into a first right coupling member and a first left coupling member. The first right coupling member may include a first right extension string, and a first right buckle coupled to an end of the first right extension string. The first left coupling member may include a first left extension string, and a first left buckle coupled to an end of the first left extension string and capable of engaging with the first right buckle.

In an embodiment, any one of the first right buckle and the first left buckle may be a male buckle while the other being a female buckle.

In an embodiment, the first right extension string may extend from the right frame, and the first left extension string may extend from the left frame.

In other embodiments, life vests may further include a pair of second rear coupling members disposed adjacent to the pair of second storage spaces.

In other embodiments, the pair of second rear coupling members may be divided into a second right coupling member and a second left coupling member. The second right coupling member may include a second right extension string and a second right buckle coupled to and end of the second right extension string. The second left coupling member may include a second left extension string and a second left buckle coupled to an end of the second left extension string and capable of engaging with the second right buckle.

In other embodiments, any one of the second right buckle and the second left buckle may be a male buckle while the other being a female buckle.

In other embodiments, the second right extension string may extend from the right frame, and the second left extension string may extend from the left frame.

In still other embodiments, life vests may further include a right ring part and a left ring part, and a right opening and a left opening may be defined in the outer cover. The right ring part may be coupled to the right frame and inserted in the right opening. The left ring part may be coupled to the left frame and inserted in the left opening.

In still other embodiments, the right frame and the right ring part may be integral, and the left frame and the left ring part may be integral.

In still other embodiments, the outer cover may include a waterproof function.

In even other embodiments, life vests may include a main body including a buoyant member, a pair of first coupling members disposed on a front portion of the main body, two pairs of second coupling members disposed on a rear portion or a side portion of the main body, and a fixing member for fixing the second coupling members to the main body.

Advantageous Effects

According to embodiments of the inventive concept, it is possible to provide life vests capable of connecting people in water to one another. Thus, multiple people can be rescued at once by pulling only one of the connected people.

According to embodiments of the inventive concept, it is possible to provide life vests capable of helping people in water to be easily rescued by rescue ropes descending from a helicopter.

MODE FOR CARRYING OUT THE INVENTION

Hereinafter, preferred embodiments of the inventive concept will be described in detail with reference to accompanying drawings.

Figure 1:
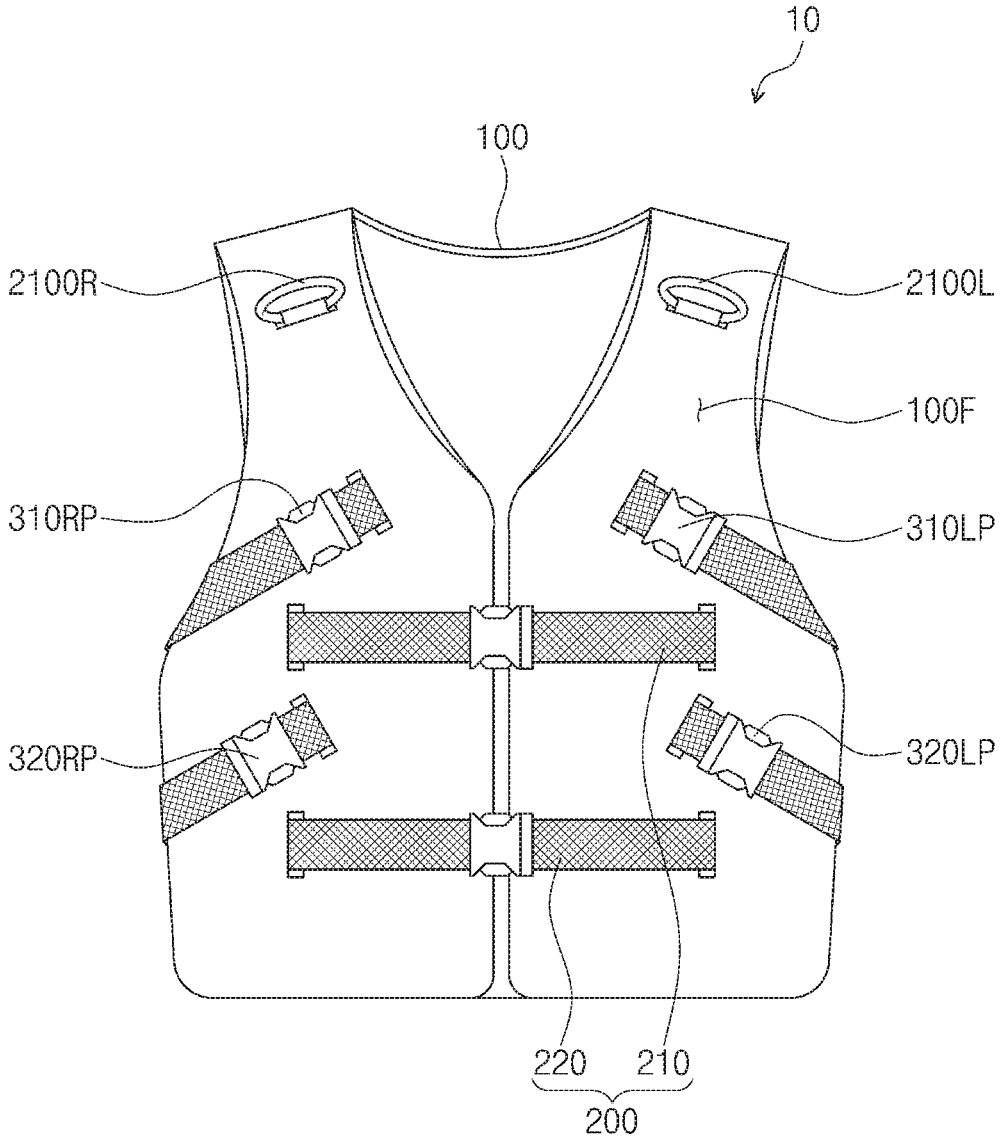
FIG. 1 is a view illustrating a front view of a life vest according to an embodiment of the inventive concept.
Figure 2A:
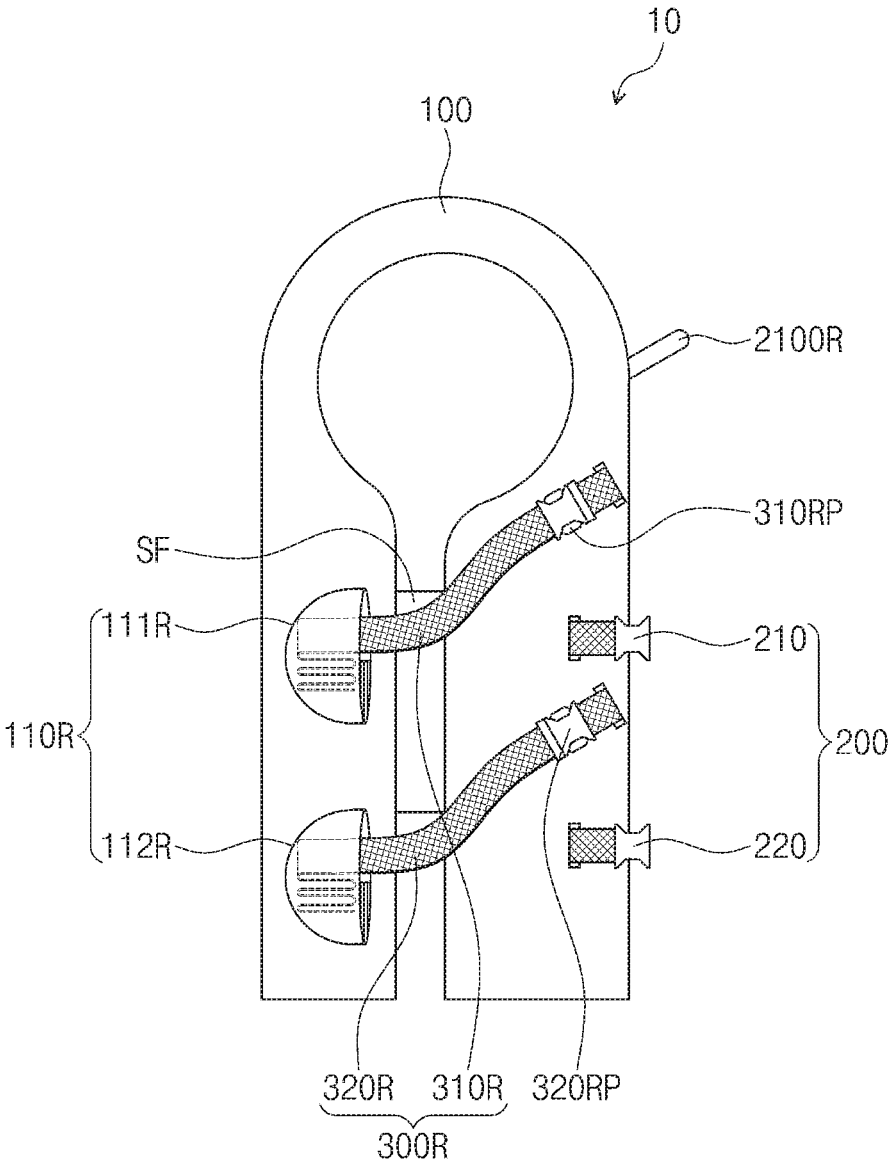
FIGS. 2A and 2B are views respectively illustrating a side view of the life vest shown in FIG. 1.
Figure 2B:
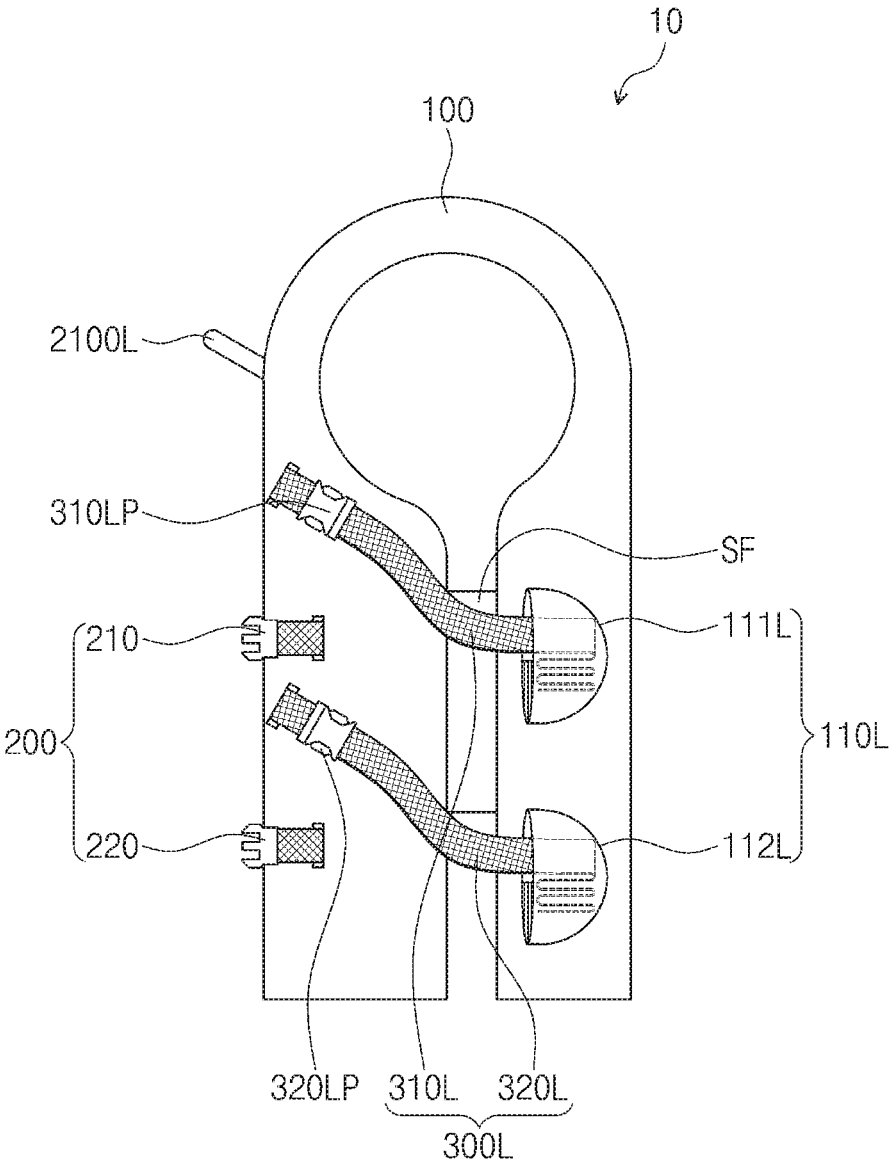
Figure 2C:
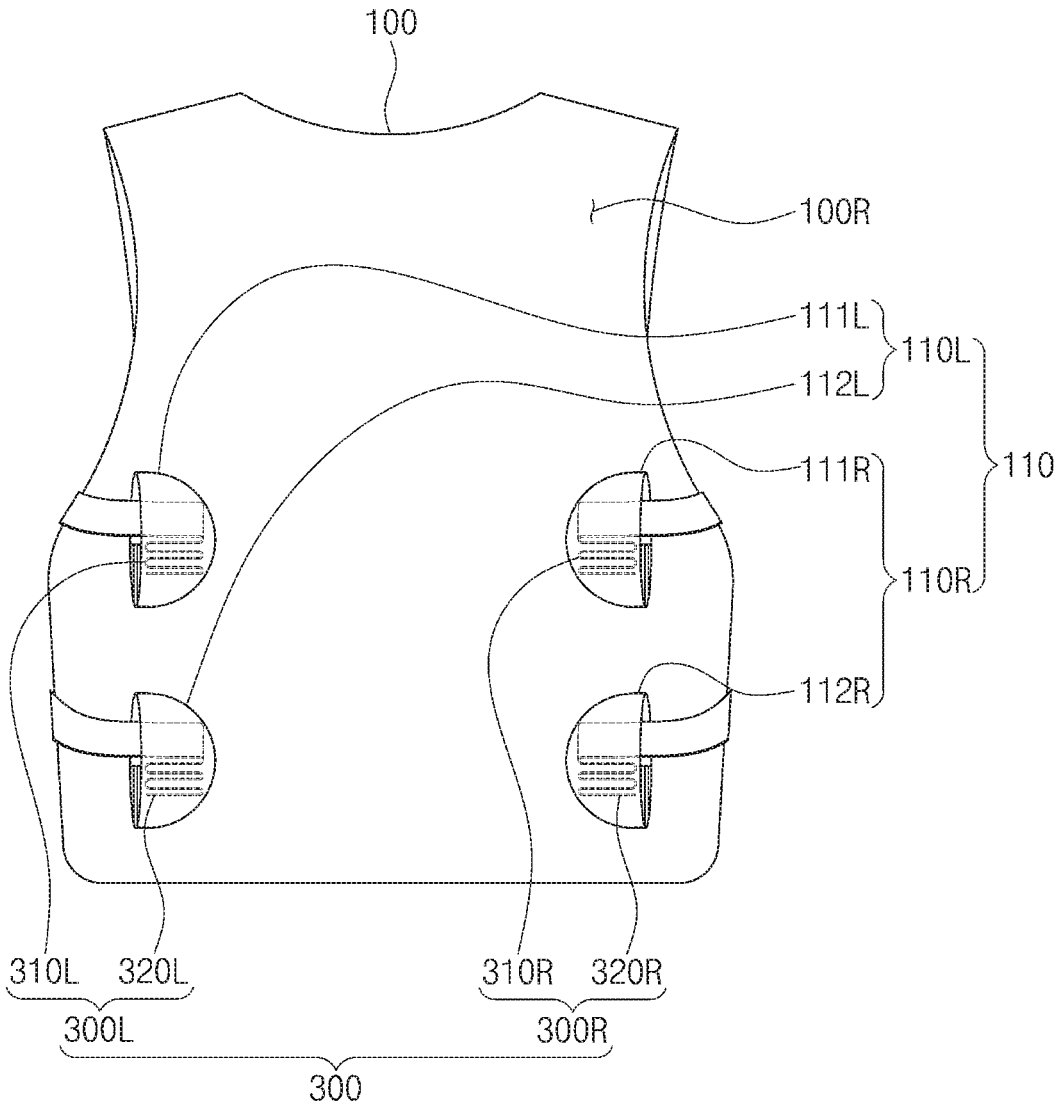
FIG. 2C is a view illustrating a rear view of the life vest shown in FIG. 1.

FIG. 1 is a view illustrating a front view of a life vest 10 according to an embodiment of the inventive concept. FIGS. 2A and 2B are views respectively illustrating a side view of the life vest 10 shown in FIG. 1. FIG. 2C is a view illustrating a rear view of the life vest 10 shown in FIG. 1.

The life vest 10 includes a main body 100, a front coupling member 200, a rear coupling member 300, and corresponding members 310LP, 310RP, 320LP and 320RP.

The main body 100 is a portion directly contacting a body part of a user, which is divided into a front part 100F and a rear part 100R. The front part 100F is a portion surrounding an abdomen and a chest portion. The rear part 100R surrounds a back portion, and has storage spaces 100R and 100L defined therein.

The storage spaces 110R and 110L may be divided into a right storage space 100R and a left storage space 110L. The right storage space 110R may include a first right storage space 111R and a second right storage space 112R. The left storage space 110L may include a first left storage space 111L and a second left storage space 112L.

The main body 100 may include a buoyant member 1000 (see FIG. 5), a frame 2000 (see FIG. 6A), and an outer cover 3000 (see FIG. 7).

The front coupling member 200 is configured to fix the life vest 10 to a user's body.

The front coupling member 200 may include a first front coupling member 210 and a second front coupling member 220. Each of the first front coupling member 210 and the second front coupling member 220 may include a left front coupling member and a right front coupling member. Any one of the left front coupling member and the right front coupling member may include a male buckle while the other includes a female buckle.

In FIGS. 1 to 2C, two front coupling members 200 are exemplified, but the inventive concept is not limited thereto.

The rear coupling member 300 a portion for engaging with a rear coupling member 300 of a life vest worn by another adjacent person.

The rear coupling member 300 may include a pair of first rear coupling members 310 and a pair of second rear coupling members 320. The rear coupling member 300 may be divided into a first right coupling member 300R (see FIG. 6B) and a left coupling member 300L (see FIG. 6B) depending on a disposed position thereof based on a wearer.

The pair of first rear coupling members 310 are divided into a first right coupling member 310R and a first left coupling member 310L. The pair of second rear coupling members 320 are divided into a second rear coupling member 320R and a second left coupling member 320L.

The first right coupling member 310R may be received in the first right storage space 111R, and the second right coupling member 320R may be received in the second right storage space 112R. The first left coupling member 310L may be received in the first left storage space 111L, and the second left coupling member 320L may be received in the second left storage space 112L. The storage spaces 110R and 110L may further include a separate configuration, such as a pair of tongs for fixing the coupling members 310R, 320R, 310L and 320L accommodated therein. The rear coupling member 300 may be received in the storage spaces 110R and 110L in a state of being partially folded. This is to secure an easiness when taking the coupling member 300 out of the storage spaces 110R and 110L upon emergency.

The corresponding members 310RP, 320RP, 310LP and 320LP may be disposed on the front part 100F. The corresponding members 310RP, 320RP, 310LP and 320LP may be divided into a first right corresponding member 310RP, a second right corresponding member 320RP, a first left corresponding member 310LP, and a second left corresponding member 320LP. The first right corresponding member 310RP may be coupled to the first right coupling member 310R. The second right corresponding member 320RP may be coupled to the second right coupling member 320R. The first left corresponding member 310LP may be coupled to the first left coupling member 310L. The second left corresponding member 320LP may be coupled to the second left coupling member 320L. In a regular situation, the corresponding members 310RP, 320RP, 310LP and 320LP remain coupled to the rear coupling member 300, but are easily decoupled therefrom to be used for a rescue work upon emergency.

Side connection members SF may be disposed on a side surface of the main body 100. The side connection members SF may connect the front part 100F and the rear part 100R of the main body 100 to prevent the life vest 10 from being taken off. In this embodiment, 4 side connection members SF are exemplified, but the inventive concept is not limited thereto.

Figure 3A:
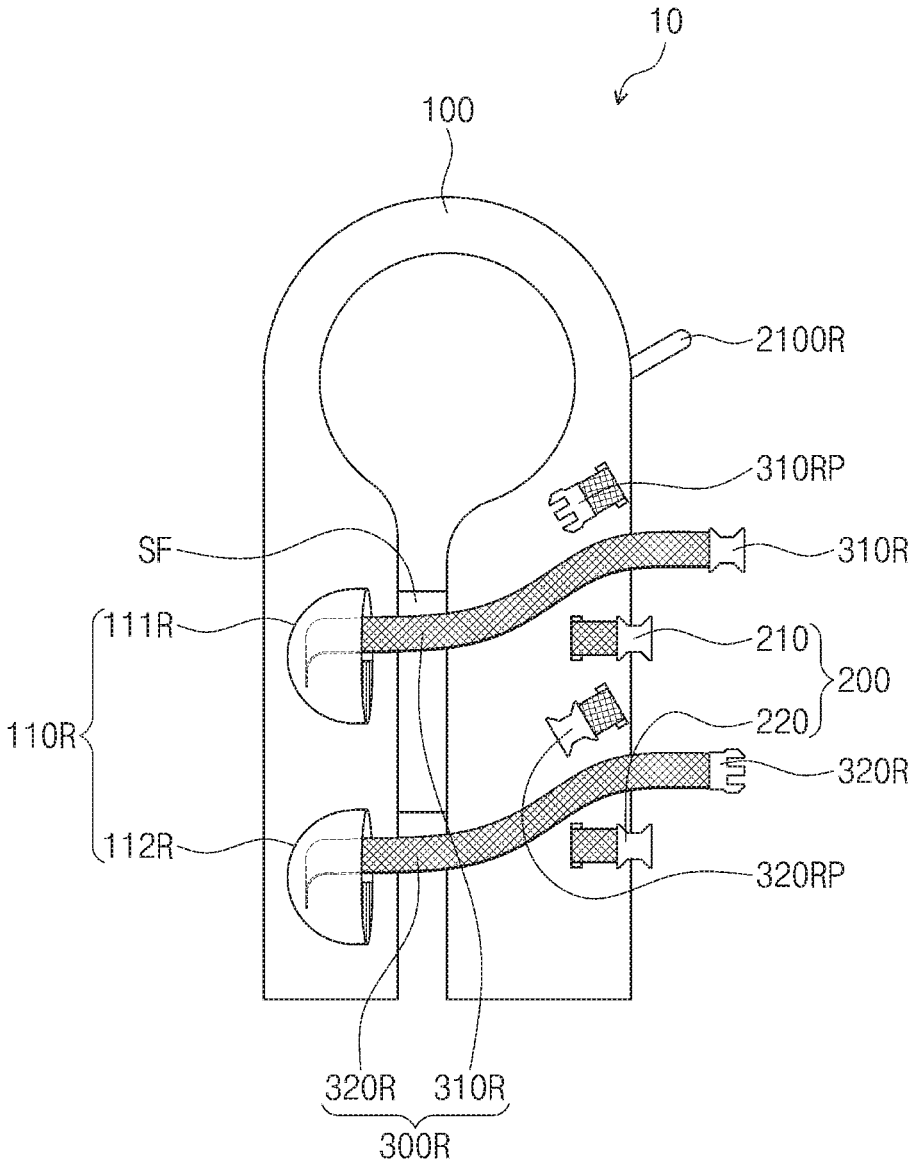
FIGS. 3A and 3B are views illustrating the life vest in which a rear coupling member is taken out of an storage space.
Figure 3B:
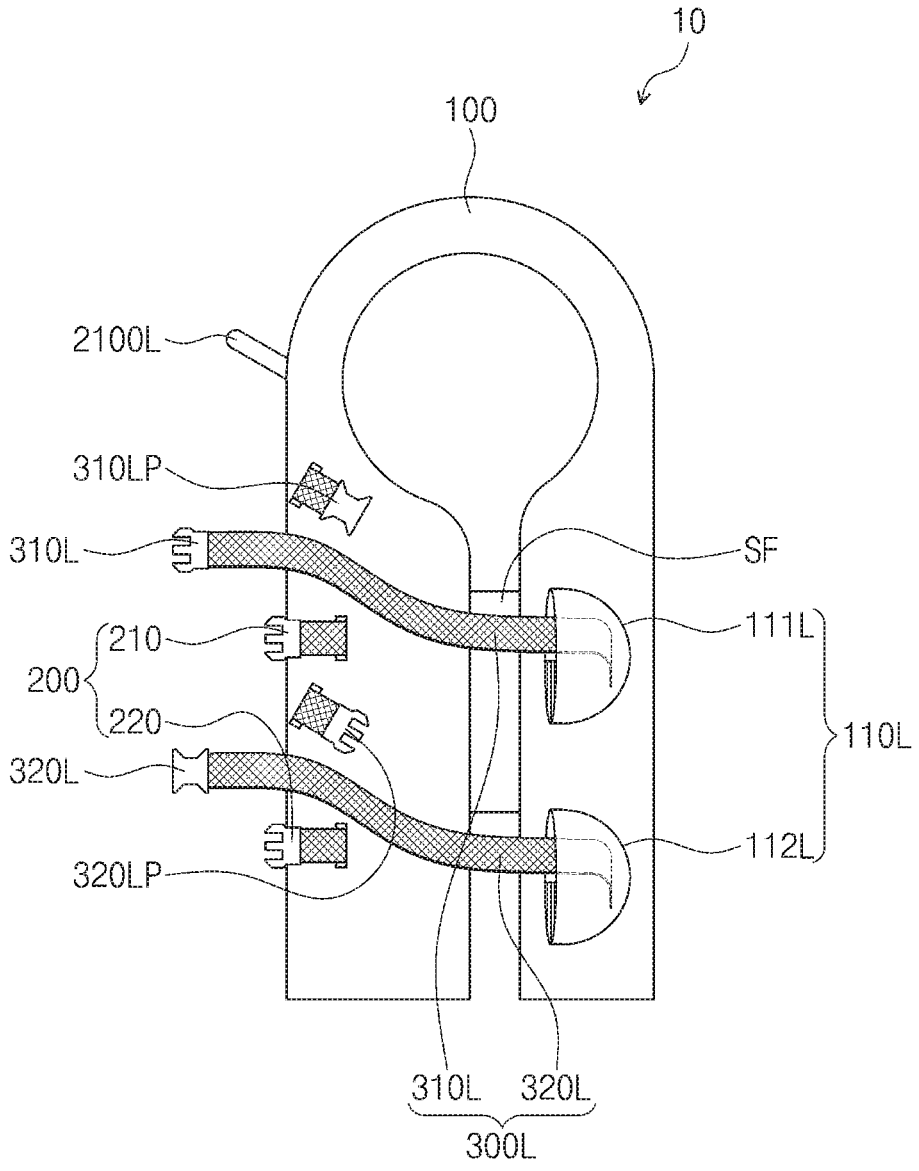

FIGS. 3A and 3B are views illustrating the life vest 10 in which the rear coupling member 300 is taken out of the storage space 110.

In a regular situation, the rear coupling member 300 is received in the storage spaces 110R and 110 as shown in FIGS. 1 to 2C, and is not used. Upon emergency or in a situation of performing a life-saving work, the rear coupling member 300 may be taken out of the storage spaces 110R and 110L and used, as shown in FIGS. 3A and 3B.

In an embodiment of the inventive concept, the storage spaces 110R and 110L are exemplified as a means for fixing the rear coupling member 300, but the inventive concept is not limited thereto. In another embodiment of the inventive concept, a separate other configuration for fixing the rear coupling member 300 may be employed.

Figure 4A:
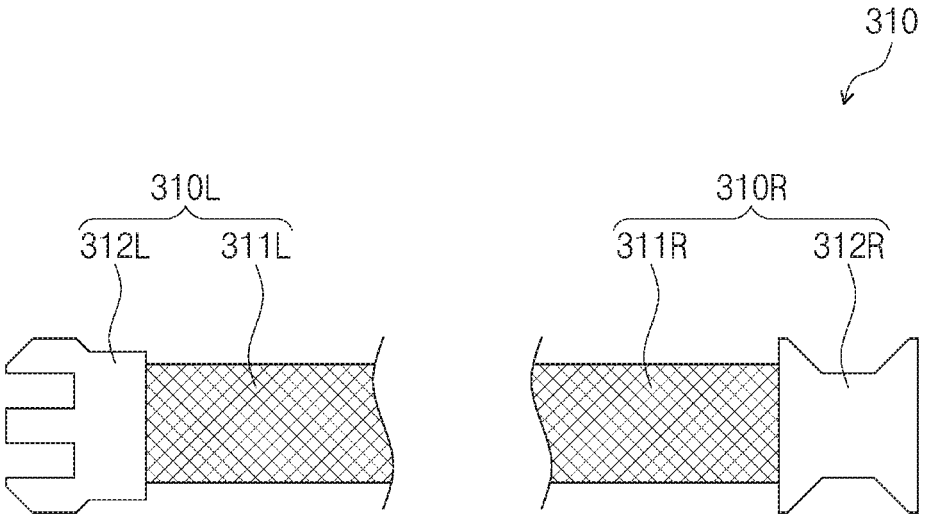
FIG. 4A is a view illustrating a pair of first rear coupling members shown in FIGS. 3A and 3B.
Figure 4B:
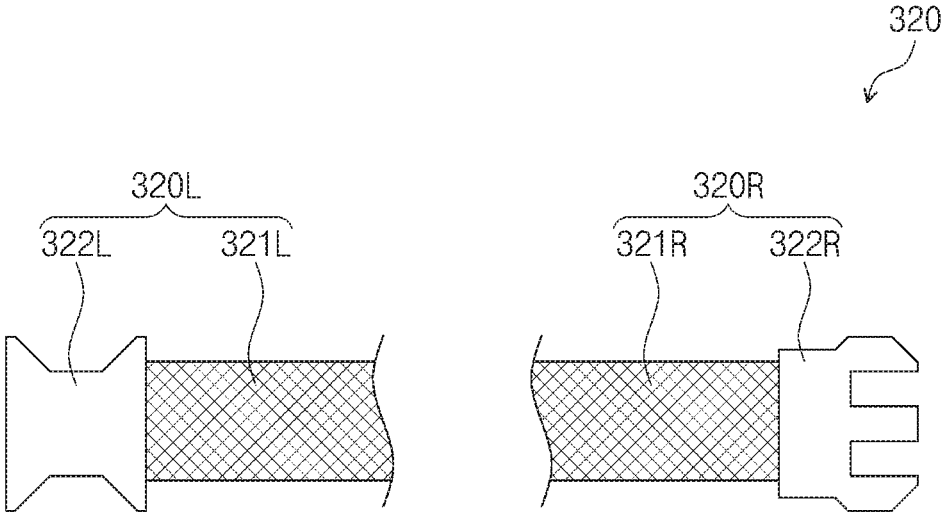
FIG. 4B is a view illustrating a pair of second rear coupling members shown in FIGS. 3A and 3B.

FIG. 4A is a view illustrating a pair of first rear coupling members 310 shown in FIGS. 3A and 3B. FIG. 4B is a view illustrating a pair of second rear coupling members 320 shown in FIGS. 3A and 3B. FIGS. 4A and 4B are views respectively illustrating the rear coupling members 310 and 320, when the life vest 10 is viewed from the rear surface.

The first right coupling member 310R includes a first right extension string 311R and a first right buckle 312R. The first left coupling member 310L includes a first left extension string 311L and a first left buckle 312L. The first right buckle 312R may be a male buckle while the first left buckle being a female buckle 312L. However, the inventive concept is not limited thereto, and in another embodiment, the first right buckle 312R may be a female buckle while the first left buckle 312L being a male buckle.

The second right coupling member 320R includes a second right extension string 321R and a second right buckle 322R. The second left coupling member 320L includes a second left extension string 331L and a second left buckle 322L. The second right buckle 322R may be a female buckle while the second left buckle 322L being a male buckle. However, the inventive concept is not limited thereto, and in another embodiment, the second right buckle 322R may be a male buckle while the second left buckle 322L being a female buckle.

The first right extension string 311R, the first left extension string 311L, the second right extension string 321R, and the second left extension string 321L may also include a polyamide-based synthetic fiber.

Figure 4C:
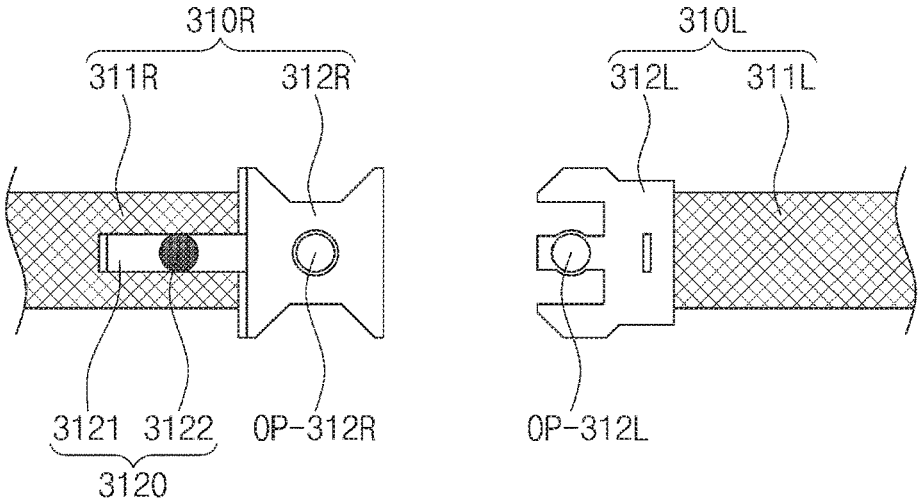
FIGS. 4C and 4D are views illustrating the pair of first rear coupling members shown in FIGS. 3A and 3B.
Figure 4D:
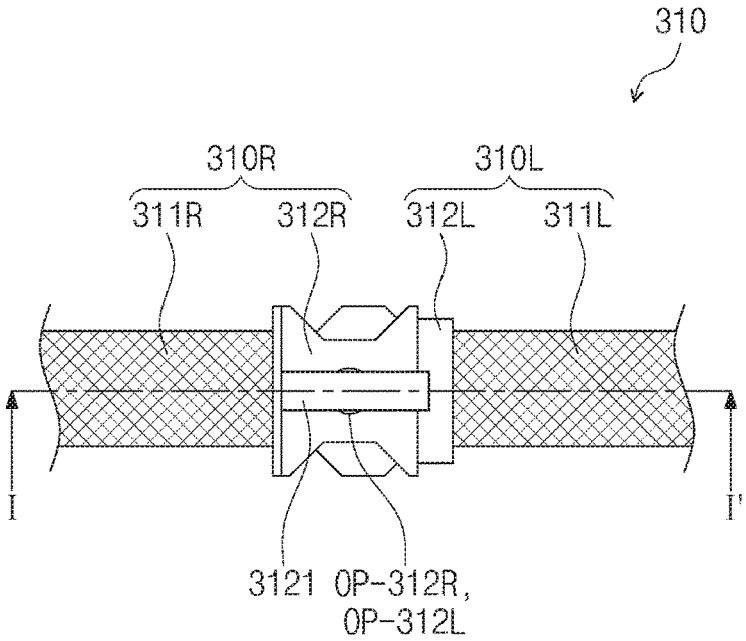
Figure 4E:
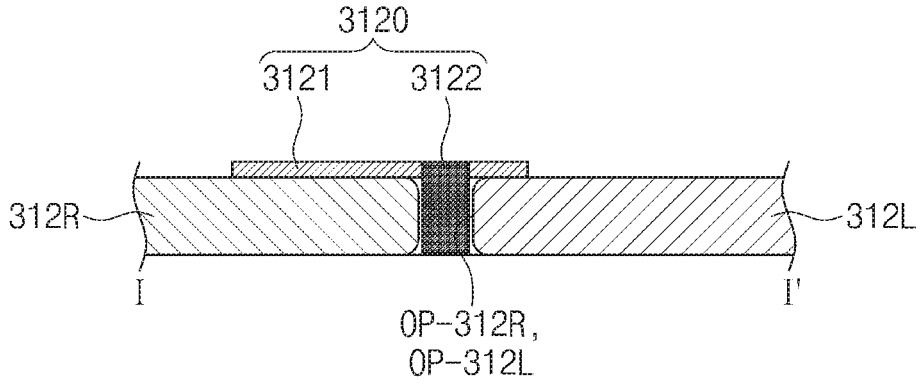
FIG. 4E is a cross-sectional view taken along a line I-I' of FIG. 4D.

FIGS. 4C and 4D are views illustrating the pair of first rear coupling members 310 shown in FIGS. 3A and 3B. FIG. 4E is a cross-sectional view taken along a line I-I' of FIG. 4D. FIG. 4C is a view illustrating the first rear coupling member 310 in a decoupled state when the life vest 10 is viewed from the front. FIG. 4D is a view illustrating the first rear coupling member 310 in a decoupled state when the life vest is viewed from the front.

A right buckle opening OP-312R may be defined in the first right buckle 312R, and a left buckle opening OP-312L may be defined in the first left buckle 312L.

The first right coupling member 310R may include a secondary buckle coupling part 3120. The secondary buckle coupling part 3120 includes a base part 3121 extending from the first right buckle 312R and an extrusion 3122 disposed on one surface of the base part 3121. However, the inventive concept is not limited thereto, and the secondary buckle coupling part 3120 may be included in the first left coupling member 310L.

Referring to FIGS. 4D and 4E, the extrusion 3122 is inserted in the right buckle opening OP-312R and the left buckle opening OP-312L. Accordingly, the first right buckle 312R and the first left buckle 312L may be coupled more firmly.

The second rear coupling member 320 may have the same shape as the first rear coupling member 310, and a detailed description thereof will be omitted.

Figure 5:
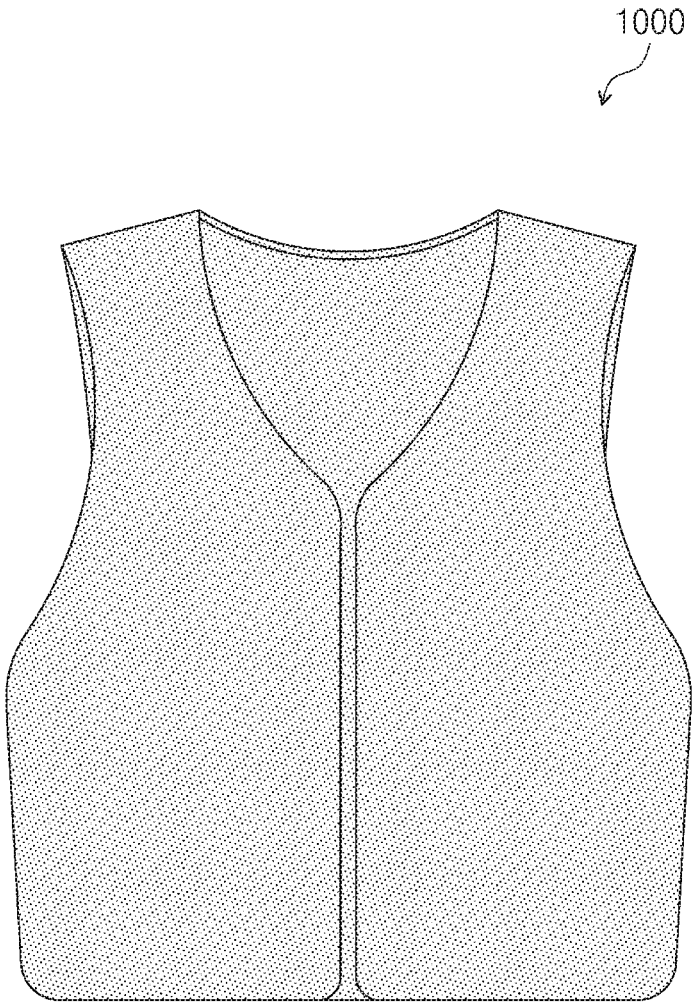
FIG. 5 is a view illustrating a buoyant member included in the main body of the life vest shown in FIG. 1.

FIG. 5 is a view illustrating a buoyant member 1000 included in the main body 100 of the life vest 10 shown in FIG. 1.

The buoyant member 1000 floats on water by buoyancy in water, which allows users to float out of the water. The buoyant member 1000 may include expandable polystyrene to have a low specific gravity to result in a large buoyancy. A material processed into a sponge form may be used for the buoyant member 1000. However, the inventive concept is not limited thereto, and in another embodiment, the buoyant member may employ all those having buoyancy.

The buoyant member 1000 is illustrated as an integral shape in FIG. 5, but the inventive concept is not limited thereto, and in another embodiment, the buoyant member may be in a form divided into a plurality of pieces. Further, each part thereof may be given a different thickness as necessary.

Figure 6A:
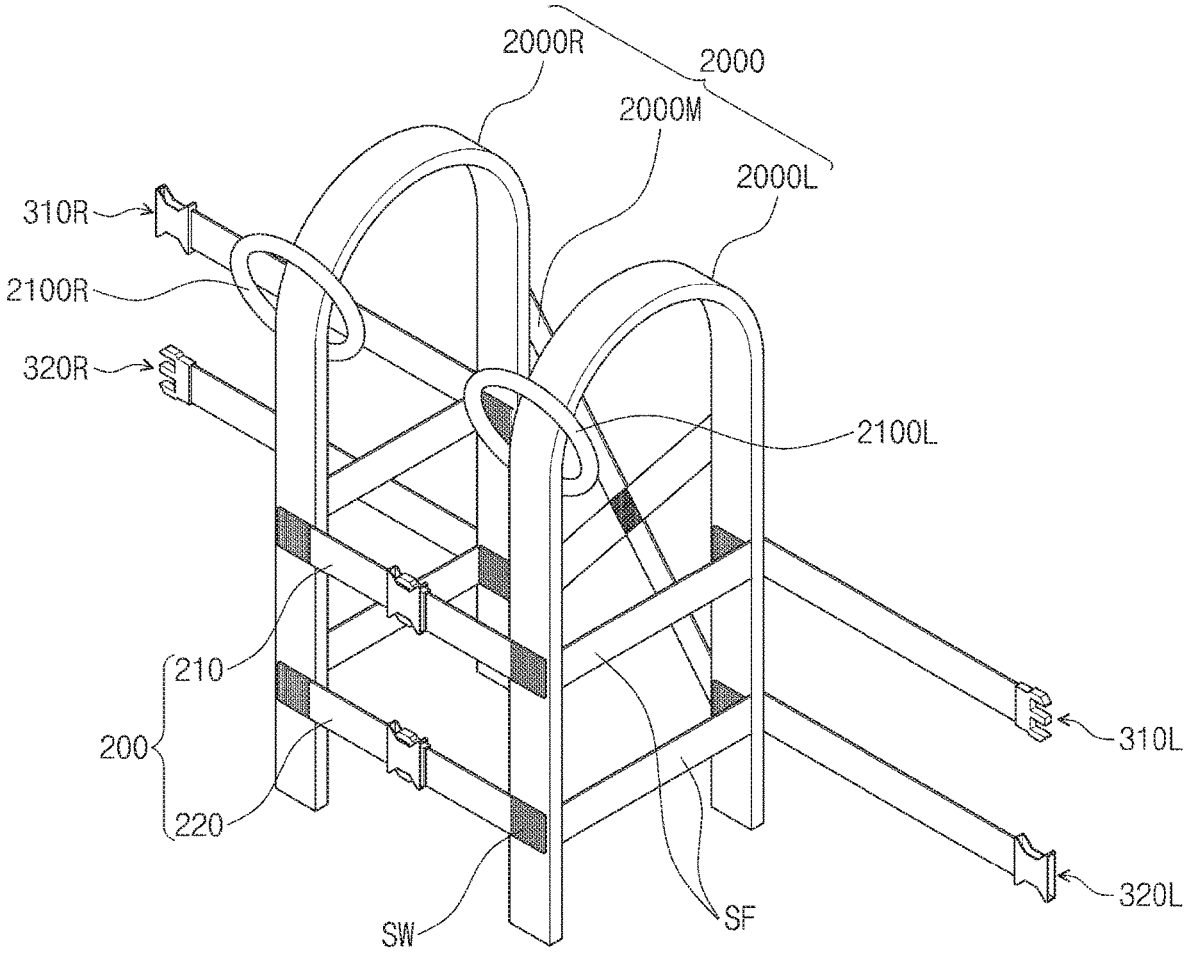
FIG. 6A is a view illustrating a frame included in the main body of the life vest shown in FIG. 1, a front coupling member extending from the frame, and a rear coupling member extending from the frame.
Figure 6B:
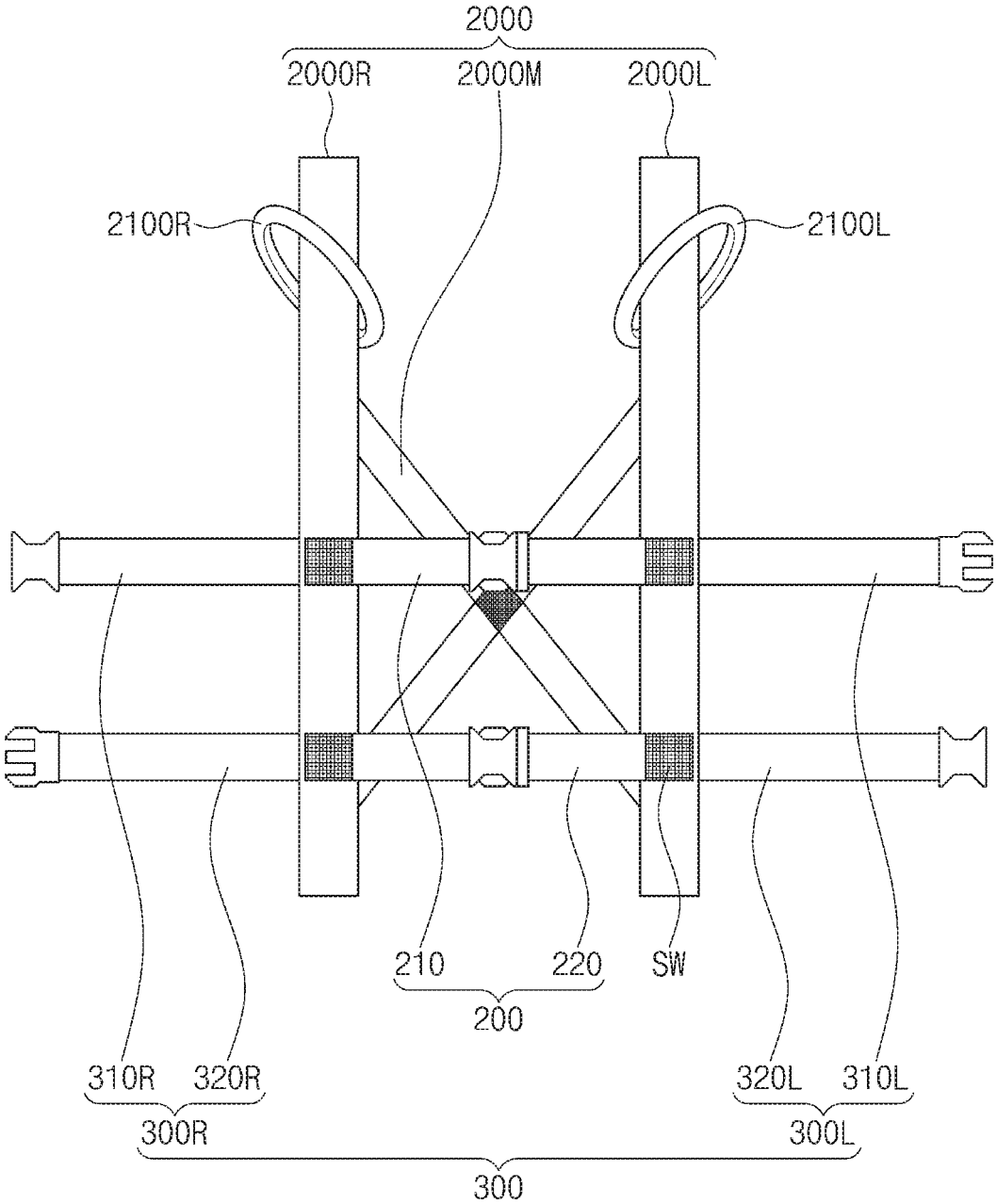
FIG. 6B is a view illustrating the view shown in FIG. 6A when viewed from the front.
Figure 6C:
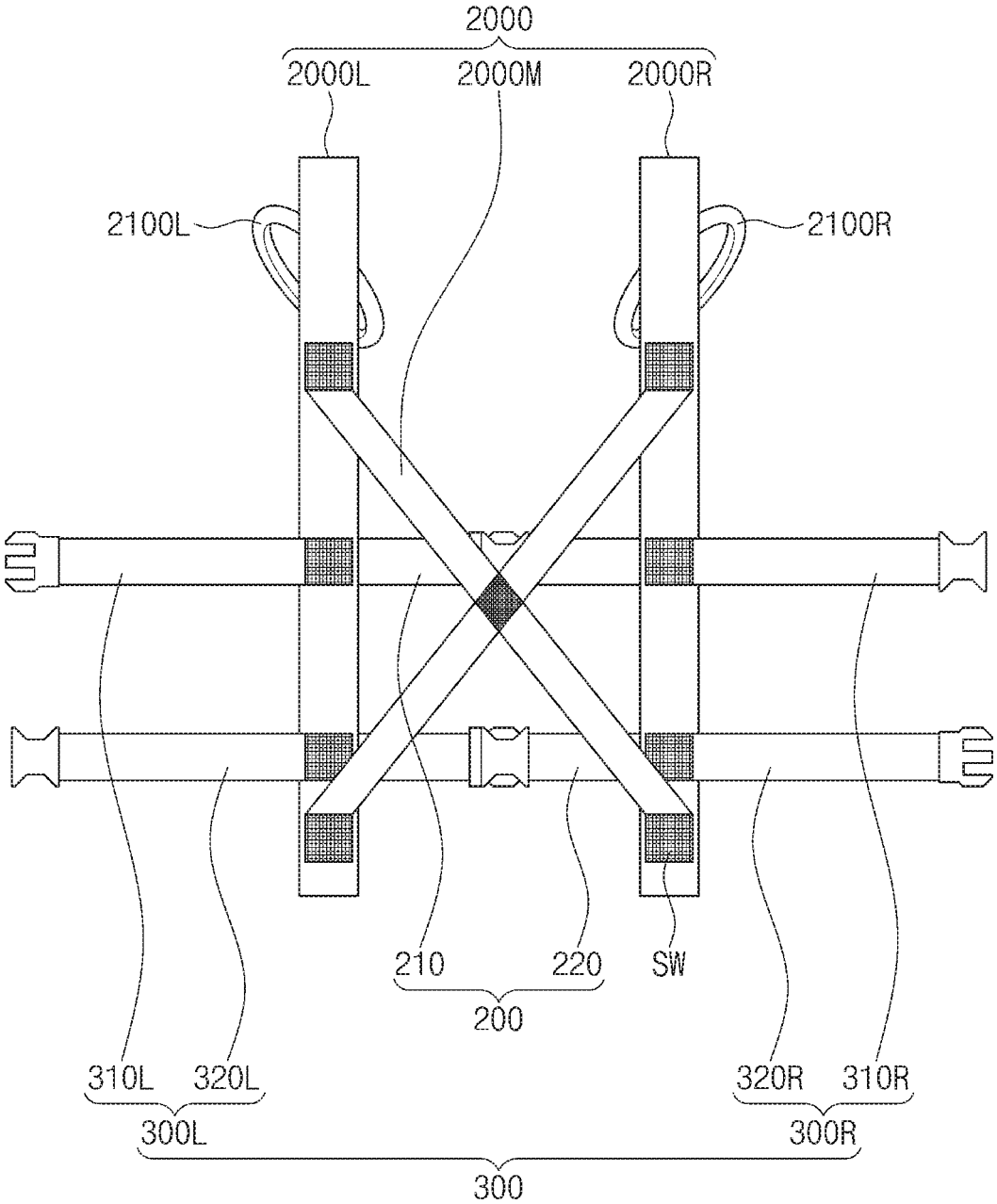
FIG. 6C is a view illustrating the view shown in FIG. 6A when viewed from the rear.

FIG. 6A is a view illustrating a frame 2000 included in the main body 100 of the life vest 10 shown in FIG. 1, a front coupling member 200 extending from the frame 2000, and a rear coupling member 300 extending from the frame 2000. FIG. 6B is a view illustrating the view shown in FIG. 6A when viewed from the front. FIG. 6C is a view illustrating the view shown in FIG. 6A when viewed from the rear.

Referring to FIG. 5, the frame 2000 is disposed adjacent to the buoyant member 1000 (see FIG. 5). Specifically, the frame 2000 may be disposed to surround an outer surface of the buoyant member 1000. The frame 2000 and the buoyant member 1000 are firmly coupled to each other by backstitching, thereby performing a base role to configuration extending from the main body 100.

The frame 2000 may include a right frame 2000R to be worn on a right shoulder of a user, a left frame 2000L to be worn a left shoulder of a user, and a middle frame 2000M connecting the right frame 2000R and the left frame 2000L. The middle frame 2000M may be a crossed form in an X-shape, and this may allow the right frame 2000R and the left frame 2000L to be connected to each other more firmly.

The first right coupling member 310R and the second right coupling member 320R may extend from the right frame 2000R, respectively. The first left coupling member 310L and the second left coupling member 320L may extend from the left frame 2000L, respectively.

The front coupling member 200 may also extend from the right frame 2000R and the left frame 2000L.

The front coupling member 200 and the rear coupling member 300 may be exposed to the openings or cutouts defined in the outside through the outer cover 3000 (see FIG. 7).

The life vest 10 may include a right ring part 2100R and a left ring part 2100L. The right ring part 2100R may be coupled to the right frame 2000R, and the left ring part 2100L may be coupled to the left frame 2000L.

The right frame 2000R and the left frame 2000L may be coupled to the middle frame 2000M by a backstitching pattern SW. Further, the front coupling member 200 and the rear coupling member 300 may be coupled to the frame 2000 by the backstitching pattern SW.

In the backstitching pattern SW, threads are double-backstitched while having a cross shape. Accordingly, the backstitch pattern has a strong durability preventing an easy burst thereof from a force applied in any direction.

The right ring part 2100R may have a ring shape that surrounds the right frame 2000R. The left ring part 2100L may have a ring shape that surrounds the left frame 2000L. However, the inventive concept is not limited thereto, and in another embodiment, the right ring part 2100R and the left ring part 2100L may have other shapes to be firmly coupled to the right frame 2000R and the left frame 2000L.

In an embodiment of the inventive concept, the right ring part 2100R may be a ring made by knotting a portion of the right frame 2000R, and the left ring part 2100L may be a ring made by knitting a portion of the left frame 2000L. This may allow forming of rings that are stronger and unbreakable than the ring parts 2100R and 2100L that are formed separately.

The side connection members SF may be connected to the left frame 2000L or the right frame 2000R, respectively. However, a connection relationship of the side connection members SF or a position on which the side connection members are disposed is not limited thereto, and in other embodiment, the side connection members SF may be separately formed on the outer surface of the main body 100. In another embodiment, the side connection members SF may be integral to the main body 100.

Figure 7A:
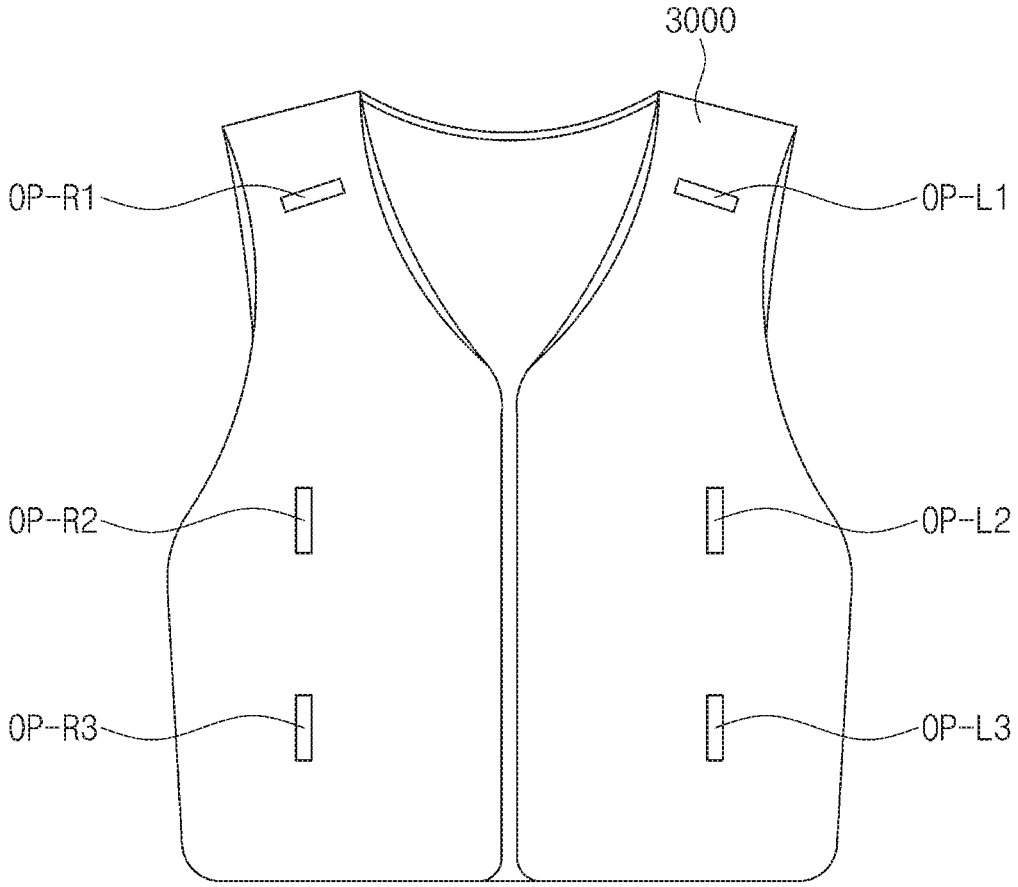
FIG. 7A is a front view of an outer cover included in the main body of the life vest shown in FIG. 1.
Figure 7B:
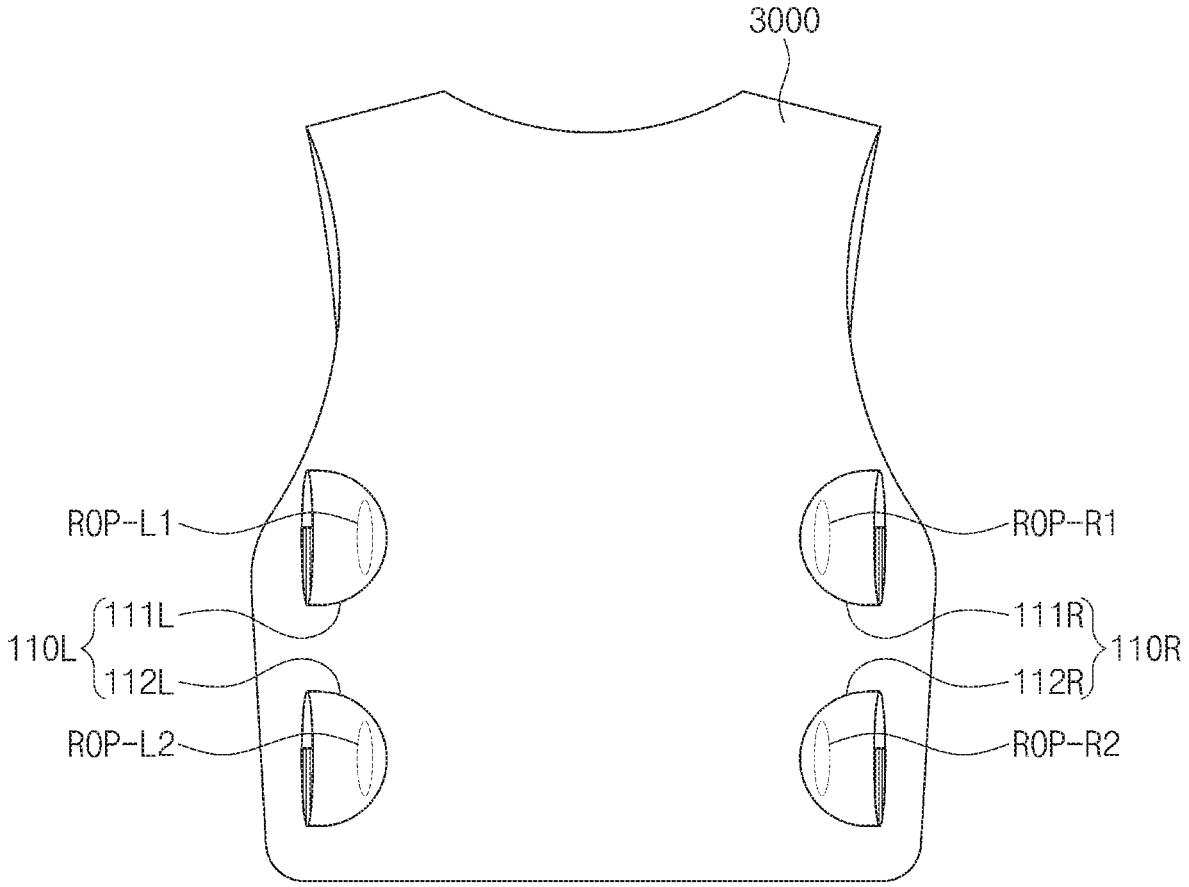
FIG. 7B is a rear view of the outer cover include in the main body of the life vest shown in FIG. 1.

FIG. 7A is a front view of an outer cover 3000 included in the main body 100 of the life vest 10 shown in FIG. 1. FIG. 7B is a rear view of the outer cover 3000 include in the main body 100 of the life vest 10 shown in FIG. 1.

The outer cover 3000 wraps the buoyant member 1000 (see FIG. 5) and the frame 2000 (see FIG. 6A), and may include a waterproof function.

Right openings OP-R1, OP-R2 and OP-R3, and left openings OP-L1, OP-L2 and OP-L3 may be defined in the front surface of the outer cover 3000. The right openings OP-R1, OP-R2 and OP-R3, and the left openings OP-L1, OP-L2 and OP-L3 may be substantially the same as cutout portions.

Referring to FIG. 6A, the right ring part 2100R may be inserted in the first right opening OP-R1 to protrude to the outside, and the left ring part 2100L may be inserted in the first left opening OP-L1 to protrude to the outside.

The first front coupling member 210 may be inserted in the second right opening OP-R2 and the second left opening OP-L2 to protrude to the outside. The second front coupling member 220 may be inserted in the third right opening OP-R3 and the third left opening OP-L3 to be exposed to the outside.

In another embodiment of the inventive concept, the first front coupling member 210 and the second front coupling member 220 may be backstitched on the surface of the outer cover 3000 to be attached thereto.

Rear openings ROP-R1, ROP-R2, ROP-L1 and OOP-L2 may be defined in the rear surface of the outer cover 3000. The rear openings ROP-R1, ROP-R2, ROP-L1 and OOP-L2 may be substantially the same as cutout portions.

Specifically, the rear openings ROP-R1, ROP-R2, ROP-L1 and OOP-L2 may be defined inside the storage spaces 110R and 110L, and the coupling members 310R, 320R, 310L and 320L (see FIG. 2C) may be inserted in the rear openings ROP-R1, ROP-R2, ROP-L1 and OOP-L2 to be exposed to the outside.

FIGS. 8, 9, 10 and 11 are views respectively illustrating a method of using live vests 10 according to an embodiment of the inventive concept.

Figure 8:
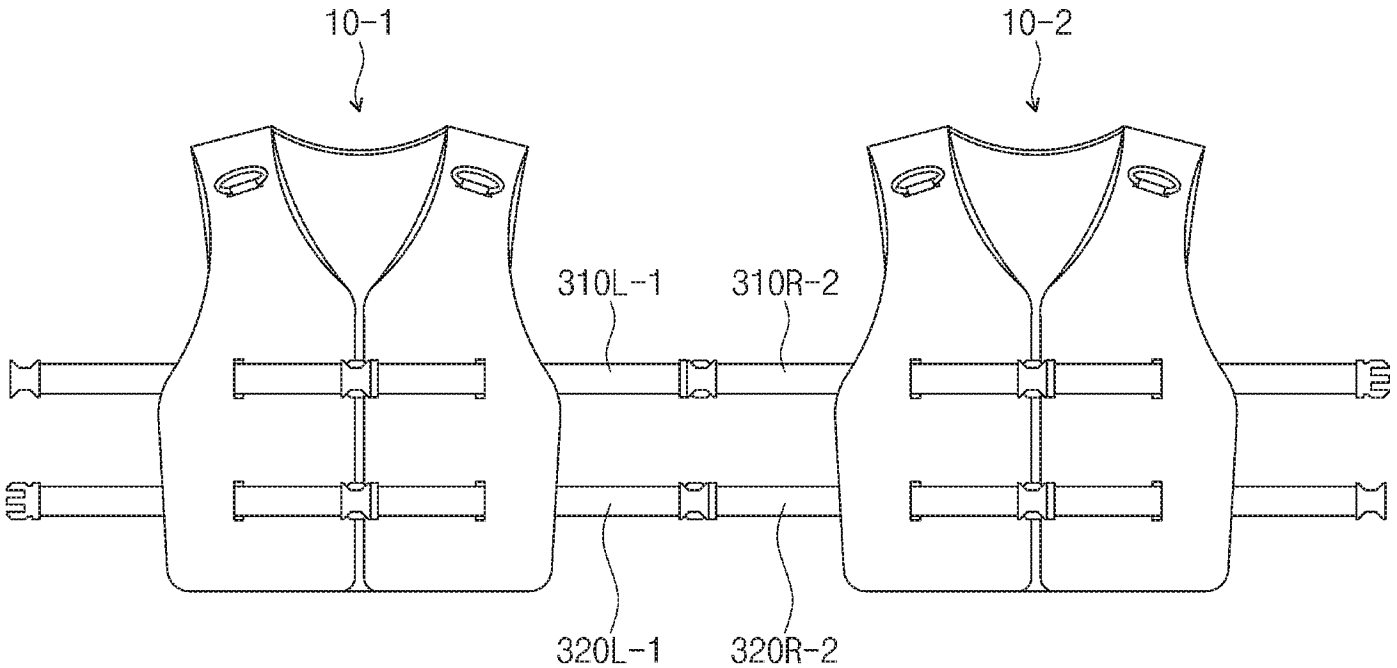
FIGS. 8, 9, 10 and 11 are views respectively illustrating a method of using live vests according to an embodiment of the inventive concept.

FIG. 8 shows two life vests 10-1 and 10-2 according to an embodiment of the inventive concept, that are coupled to each other. People wearing the life vests 10-1 and 10-2 are not illustrated in FIG. 8 for the convenience of explanation.

A first left coupling member 310L-1 of the life vest 10-1 shown on the left is coupled to a first right coupling member 310R-2 of the life vest 10-2 shown on the right. A second left coupling member 320L-1 of the life vest 10-1 shown on the left is coupled to a second right coupling member 320R-1 of the life vest 10-2 shown on the right.

Figure 9:
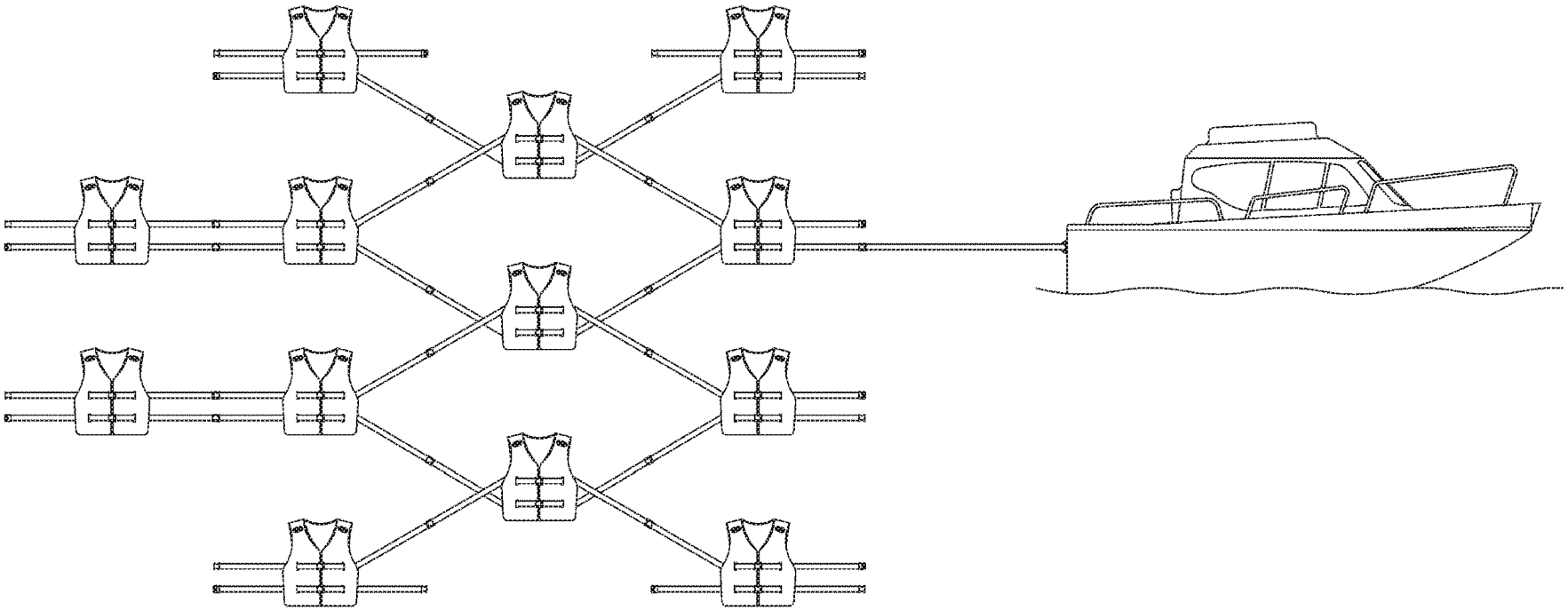

FIG. 8 shows a plurality of life vests 10 according to embodiments of the inventive concept, that are coupled to one another. If people wearing the life vests 10 according to embodiments of the inventive concept fell into water at once, the life vests 10 may be connected to one another as shown in FIG. 9. Then, all the people that are connected to one another may be rescued even by merely pulling only one of those connected. Further, simply connecting the people to one another in such manner may avoid some of those from being drifted away and disappearing by sea currents.

Figure 10:
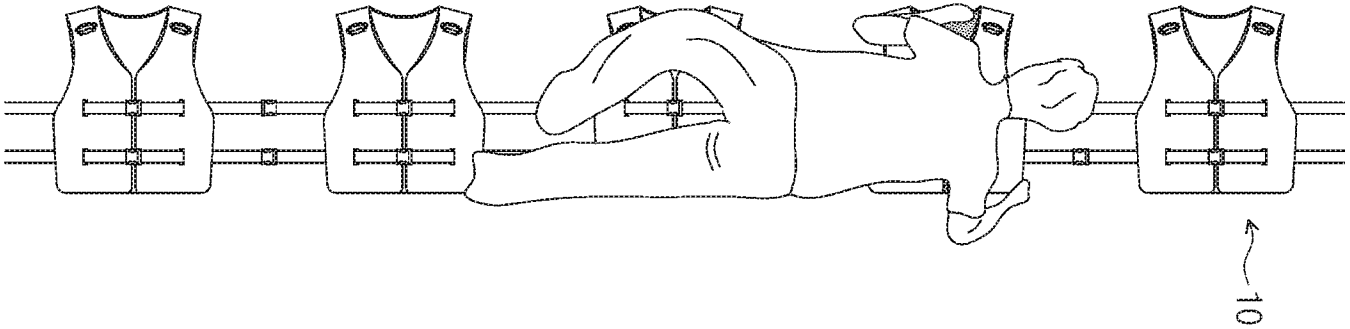

Referring to FIG. 10, the life vests 10 may be connected to each other to be used as a ladder. Thus, if a vessel is turned upside down or leaning to urgently require a ladder, the life vests 10 may be connected to be used as a replacement of the ladder.

Figure 11:
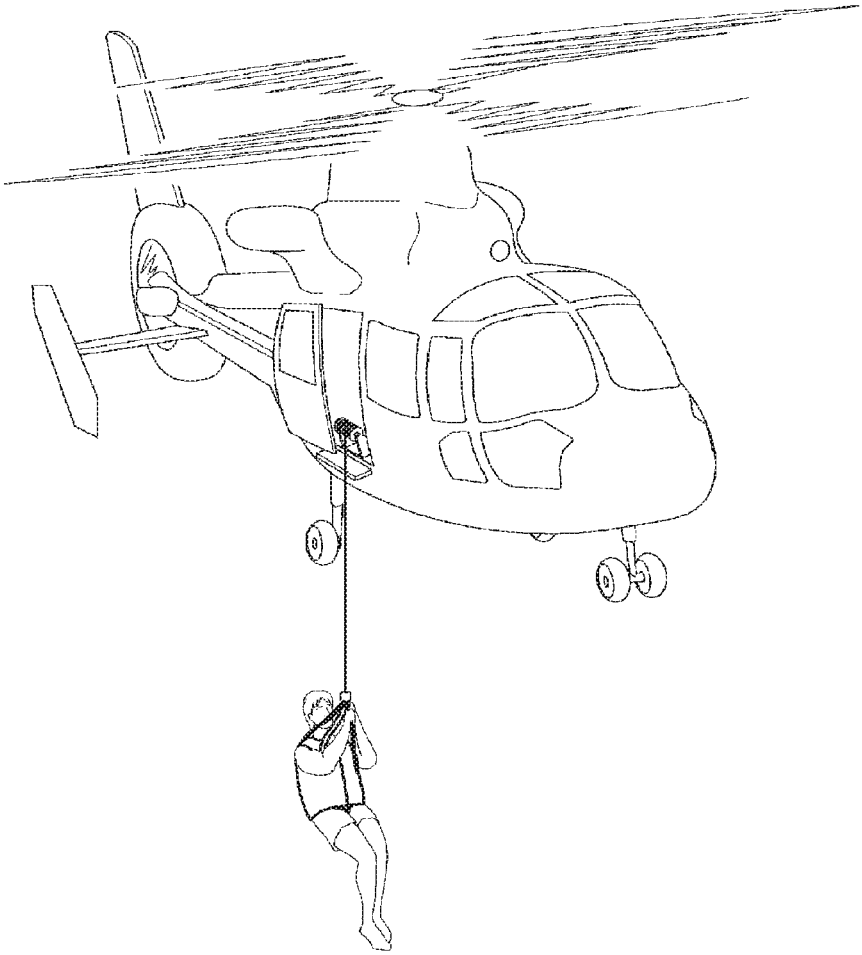

FIG. 11 shows a rescue scene by a helicopter, using the life vest 10 according to embodiments of the inventive concept.

Referring to FIG. 6A, a rescue work may be facilitated by connecting the right ring part 21 OCR and the left ring part 2100L of the life vest 10 to a rescue rope descending from the helicopter.

While the present invention has been described with reference to embodiments thereof, it will be understood by those skilled in the art that various changes and modifications may be made therein without departing from the spirit and scope of the invention defined by the appended claims. Further, embodiments disclosed herein are not intended to limit the technical spirit of the invention, and all technical spirit within the claims and an equivalent range thereof shall be construed as being included in the present invention.

INDUSTRIAL APPLICABILITY

Life vests are indispensable in taking a boat, in rescue activities, or in water related leisure activities. Thus, the present invention relating to the life vests has a high industrial usability.

The invention claimed is:

1. A life vest comprising: a main body divided into a front part for surrounding an abdomen and a chest portion, and a rear part for surrounding a back portion and having a pair of first storage spaces defined therein;

a pair of front coupling members coupled to the front part; and a pair of first rear coupling members coupled to the rear part and respectively comprising buckles of different kinds, wherein the pair of first storage spaces receive the pair of first rear coupling members, wherein the pair of front coupling members comprise:

a left front coupling member; and a right front coupling member, wherein one of the left front coupling member and the right front coupling member includes a male buckle and the other includes a female buckle capable of engaging with the male buckle, and wherein the main body comprises:

a buoyant member floating on water by buoyancy in water;

a frame disposed adjacent to the buoyant member; and an outer cover wrapping the buoyant member and the frame.

2. The life vest in claim 1, wherein the frame comprises:

a right frame to be worn on a right shoulder;

a left frame to be worn on a left shoulder; and a middle frame connecting the right frame and the left frame.

3. The life vest in claim 2, wherein the pair of first rear coupling members are divided into a first right coupling member and a first left coupling member, wherein the first right coupling member comprises:

a first right extension string; and a first right buckle coupled to an end of the first right extension string, and wherein the first left coupling member comprises:

a first left extension string; and a first left buckle coupled to an end of the left extension string and capable of engaging with the first right buckle.

4. The life vest in claim 3, wherein any one of the first right buckle and the first left buckle is a male buckle while the other being a female buckle.

5. The life vest in claim 4, wherein the first right extension string extends from the right frame, and the first left extension string extends from the left frame.

6. The life vest in claim 5, further comprising a pair of second rear coupling members coupled to the rear part, wherein a pair of second storage spaces are further defined in the rear part of the main body.

7. The life vest in claim 6, wherein the pair of second storage spaces receive the pair of second rear coupling members.

8. The life vest in claim 6, wherein the pair of second rear coupling members are divided into a second right coupling member and a second left coupling member, wherein the second right coupling member comprises:

a second right extension string; and a second right buckle coupled to an end of the second right extension string, and wherein the second left coupling member comprises:

a second left extension string; and a second left buckle coupled to an end of the second left extension string, and capable of engaging with the second right buckle.

9. The life vest in claim 8, wherein any one of the second right buckle and the second left buckle is a male buckle while the other being a female buckle.

10. The life vest in claim 9, wherein the second right extension string extends from the right frame, and the second left extension string extends from the left frame.

11. The life vest in claim 4, further comprising a right ring part coupled to the right frame and inserted in a right opening; and a left ring part coupled to the left frame and inserted in a left opening, wherein the right opening and the left opening are defined in the outer cover.

12. The life vest in claim 11, wherein the right frame and the right ring part are integral, and the left frame and the left ring part are integral.

13. The life vest in claim 3, further comprising corresponding members disposed on the front part and coupled to the rear coupling members, wherein at least one of the corresponding members is a female buckle and at least one of the corresponding member is a male buckle.

14. The life vest in claim 1, wherein the pair of first rear coupling members are divided into a first right coupling member and a first left coupling member, wherein the first right coupling member or the first left coupling member is connected to a coupling member of another adjacent life vest.

* * * * *